United States Patent [19]

Jairam

[11] Patent Number: 5,036,335

[45] Date of Patent: Jul. 30, 1991

[54] TAPERED SLOT ANTENNA WITH BALUN SLOT LINE AND STRIPLINE FEED

[75] Inventor: Hari L. Jairam, Harrow, England

[73] Assignee: The Marconi Company Limited, England

[21] Appl. No.: 524,594

[22] Filed: May 17, 1990

[30] Foreign Application Priority Data

Jun. 9, 1989 [GB] United Kingdom ..... 8913311

[51] Int. Cl.[5] ..... H01Q 1/38; H01Q 13/08

[52] U.S. Cl. ..... 343/767; 343/859

[58] Field of Search ..... 343/767–770, 343/700 MS File, 772, 859; 333/26

[56] References Cited

U.S. PATENT DOCUMENTS 4,843,403 6/1989 Lalezari et al. ..... 343/700 MS 4,853,704 8/1989 Diaz et al. ..... 343/770

FOREIGN PATENT DOCUMENTS 257881 3/1988 European Pat. Off. .

1601441 10/1981 United Kingdom .

*Primary Examiner*—Michael C. Wimer

*Attorney, Agent, or Firm*—Kirschstein, Ottinger, Israel & Schiffmiller

[57] ABSTRACT

An exponentially tapered slot (Vivaldi) antenna for producing an end-fire beam. The antenna features a novel balun for coupling with a feed line. The conventional Vivaldi antenna is fed by means of a stripline section (1) underlying the ground plane (5) and lying perpendicular to the axis of the slot line (3). This balun arrangement has an inherent narrow bandwidth. In the proposed antenna arrangement the slot line (14) and the stripline (16) each have a 45° twist centered on a common cross-over point ($X_o$,$Y_o$). The stripline (16) is terminated by a short-circuit to the ground plane (12) and the slot line (14) is terminated by an open-circuit in the form of a circular slot (15). The E-plane and H-plane radiation characteristics are similar to those of the conventional Vivaldi antenna, but the arrangement has a broadband capability enabling operation over any 3 to 1 bandwidth in the frequency range 1 to 40 GHz.

5 Claims, 4 Drawing Sheets

TAPERED SLOT ANTENNA WITH BALUN SLOT LINE AND STRIPLINE FEED

BACKGROUND OF THE INVENTION

1. Field of the Invention

This invention relates to antenna arrangements, and in particular to such arrangements comprising a tapered slot antenna and a balun for coupling a feed line with the antenna.

2. Description of Related Art

A tapered slot antenna formed on a substrate is conventionally coupled with a feed line via a balun comprising a straight length of stripline on the main face of the substrate opposite the tapered slot antenna extending at right angles to a slot line extending from the narrower end of the tapered slot. This form of balun has an inherent narrow bandwidth characteristic.

It is an object of the invention to provide an antenna arrangement comprising a tapered slot antenna and a balun for coupling a feed line with the antenna wherein the balun has a broader bandwidth capability than corresponding known arrangements.

According to the invention, an antenna arrangement comprises an antenna, a feed line and a balun for coupling the antenna with the feed line, wherein said antenna comprises a tapered slot in an electrically conductive layer carried on one main face of an electrically insulating substrate, and said balun comprises a non-tapered slot line forming an extension of the narrower end of said tapered slot and terminated by an open-circuit, and a length of stripline carried on an opposite main face of said substrate extending from said feed line and terminated by a short-circuit, said slot line and said stripline each having a 45° twist, the two twists being centred about a common point in the plane of said substrate.

The tapered slot is preferably exponentially tapered.

The section of the stripline between said feed line and said point is preferably aligned with the section of said slot line between said narrower end of the tapered slot and said point.

In a preferred embodiment of the invention, the length of said slot line between said point and said open-circuit is one quarter of the guide wavelength in the slot line at twice the lower operating frequency of said antenna, and the length of said stripline between said point and said short-circuit is one quarter of the guide wavelength in the stripline at twice the lower operating frequency of said antenna.

The open-circuit preferably comprises a circular slot in said conductive layer, the slot having a diameter equal to one quarter of the guide wavelength in said slot line at the upper operating frequency of said antenna.

BRIEF DESCRIPTION OF THE DRAWINGS

One antenna arrangement in accordance with the invention will now be described, by way of example, with reference to the accompanying drawings, of which.

DETAILED DESCRIPTION OF THE PREFERRED EMBODIMENTS

Figure 1:
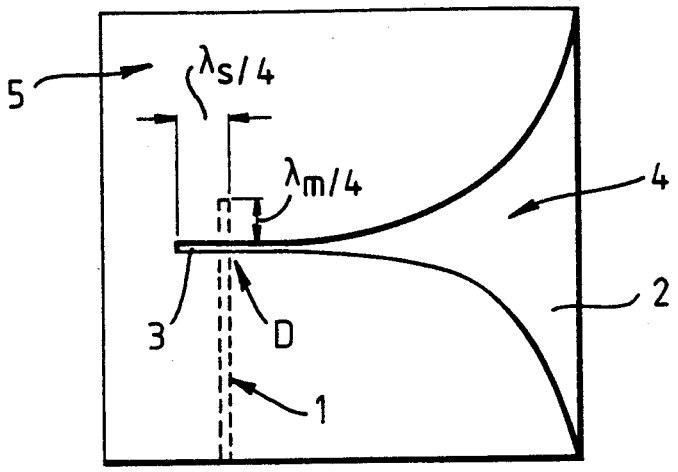
Fig. 1. PRIOR ART
FIG. 1 is an illustration of an exponentially tapered slot antenna having a conventional coupling according to the Prior Art.

FIG. 1 shows an exponentially tapered slot (Vivaldi) antenna 2 defined by a metallised layer 5 on one main face of a substrate 4. The antenna 2 has a conventional feed arrangement comprising a stripline defined by a narrow conductor 1 (dotted) on one main face of the substrate 4 and a slot line 3 extending from the narrower end of the slot antenna 2 to form a balun by crossing over one another at right angles at a point D. The stripline 1 terminates in an open-circuit and extends beyond the slot line 3 by a distance $\lambda_m/4$. The slot line 3 terminates in a short-circuit and extends beyond the stripline 1 by a distance $\lambda_s/4$. $\lambda_m$ and $\lambda_s$ are respectively the guide wavelength in the stripline 1 and the slot line 3 at the operating frequency of the antenna. Thus, at the cross-over point D the stripline 1 is effectively short-circuit and the slot line 3 is effectively open-circuit. This form of balun has an inherent narrow bandwidth characteristic, as shown by the return loss plot in FIG. 6 (dashed line).

Figure 2:
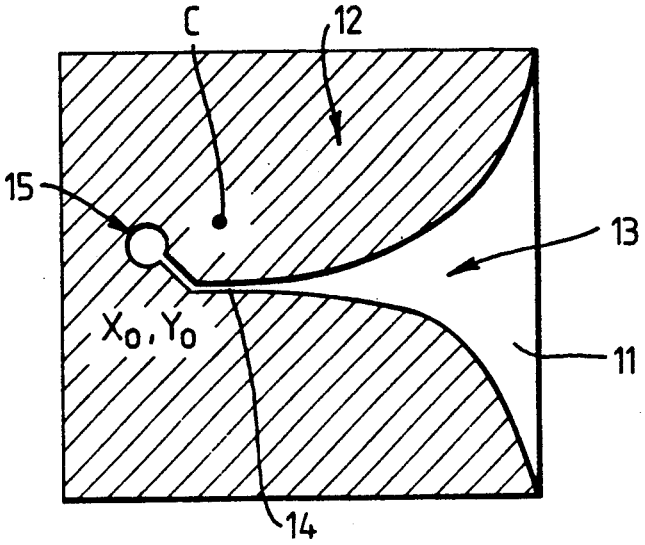
FIG. 2 shows the antenna and part of a balun in the arrangement according to the invention.
Figure 3:
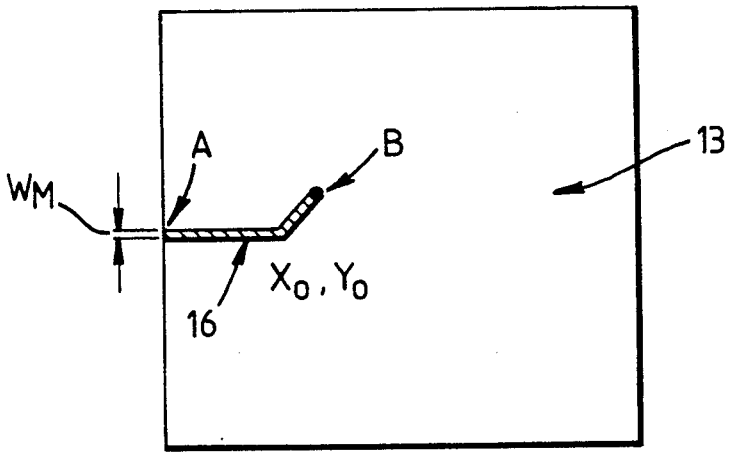
FIG. 3 shows a stripline comprising another part of the balun in the arrangement according to the invention.

Referring now to FIG. 2, the antenna arrangement according to the invention comprises an exponentially tapered slot antenna 11 defined by a metallised layer 12 on one main face of a dielectric substrate 13, the antenna 11 having the same shape as the antenna 2 of FIG. 1, and a non-tapered slot line 14 forming an extension of the narrower end of the slot antenna 11. The slot line 14 comprises two straight sections 14A and 14B (FIG. 5) meeting at a 45° twist at the point $X_o,Y_o$ and terminates at the end remote from the antenna 11 in an open-circuit in the form of a circular slot 15. On the other main face of the substrate 13 there is a narrow conductor 16 which, with the layer 12, defines a length of microstrip line as shown in plan view in FIG. 3. The microstrip line 16 comprises two straight sections 16A and 16B (FIG. 5) meeting at a 45° twist centred on the same point $X_o,Y_o$ as the centred on the same point $X_o,Y_o$ as the twist in the slot line 14. The section 16A of that line 16 is aligned with the section 14A of the slot line 14 between the point $X_o,Y_o$ and the antenna 11. At a point B at the end of the other section 16B of the line 16 remote from the point $X_o,Y_o$ the line 16 is terminated by a short-circuit through the substrate 13 to an opposing point C on the metallised layer 12. At point A on the edge of the substrate 13 the line 16 and metallised layer 12 may be connected in the conventional manner to a connector (not shown) for a transmission line, such as a coaxial cable, to feed the antenna 11.

Figure 5:
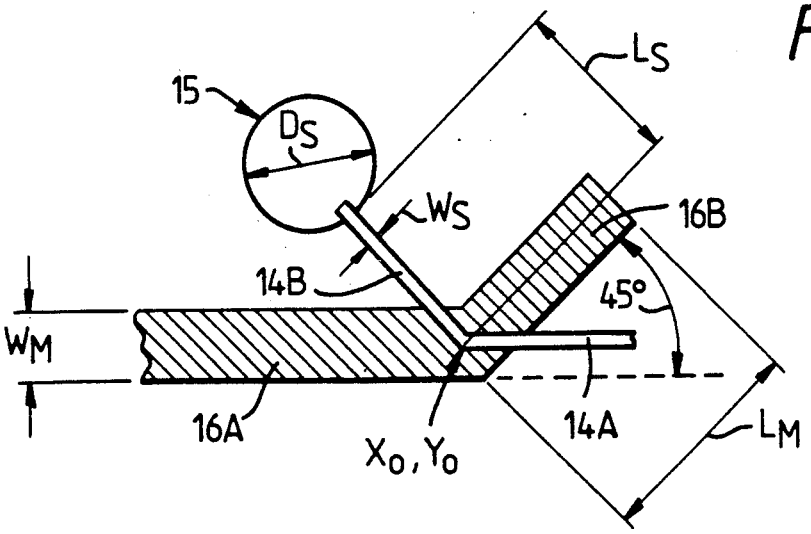
FIG. 5 is an enlarged view of the balun in the antenna arrangement according to the invention.

FIG. 5 is an enlarged view of the slot line 14 and the line 16 in the vicinity of the cross-over point $X_o,Y_o$. The width $W_S$ of the slot line 14 and width $W_M$ of the line 16 are determined in dependence on the desired input impedance for the antenna and the thickness and dielectric constant of the substrate 13.

The length $L_M$ of the line 16, measured between the point $X_o, Y_o$ and the short-circuit point C on the layer 12 (FIG. 2), i.e. section 16B of the line 16, is given by:

$$L_M = \lambda^1{}_M/4$$

The length $L_S$ of the slot line 14, measured between the point $X_o, Y_o$ and the circumference of the circular slot 15, i.e. section 14B of the slot line 14, is given by:

$$L_S = \lambda^1{}_S/4$$

where $\lambda^1{}_M$ and $\lambda^1{}_s$ are respectively the guide wavelength in the microstrip line 16 and the slot line 14 at $2f_o$, $f_o$ being the design lower operating frequency of the antenna 11. The guide wavelength in each case is calculated in the manner known to those skilled in the art.

The diameter $D_S$ of the circular slot is given by:

$$D_S = \lambda^{11}{}_S/4$$

where $\lambda_S{}^{11}$ the guide wavelength in the slot line 14 at $3f_o$.

Figure 4A:
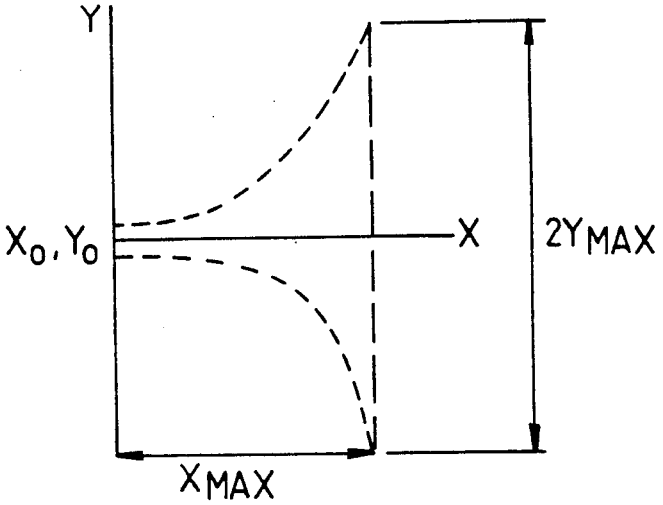
FIGS. 4*a* and 4*b* illustrate details of the tapered slot of the exponentially tapered slot antenna.
Figure 4B:
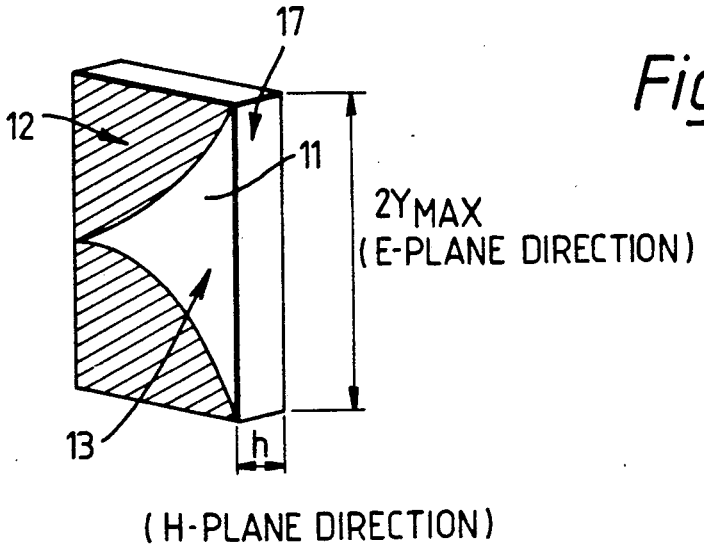

The exponential profile of the tapered slot antenna 11 is shown in FIGS. 4*a* and 4*b*. The dimensions $X_{MAX}$ and $Y_{MAX}$ indicated in FIG. 4*a* are calculated according to the equations:

$$X_{MAX} = \lambda_S$$

$$\text{and } Y_{MAX} = X_{MAX}/2$$

where $\lambda_S$ is the guide wavelength in the slot line 14 at $f_o$, the lower operating frequency of the antenna.

The exponential profile is defined by the equation, $$Y = k_1 e^{k_2 X}$$

where $k_1, k_2$ are constants chosen to provide the required bandwidth capability.

FIG. 4*b* also indicates the E-plane and H-plane radiation directions and the aperture 17 of the antenna 11.

One realisation of an antenna arrangement according to the invention is based on the following design parameters:

| | |
|---|---|
| substrate - material | RT Duroid 6010.5 |
| thickness, h | 1.5 mm |
| dielectric constant | 10.2 |
| line impedance | 50 ohm |
| lower design frequency, $f_0$ | 2 GHz |
| $k_1$ | 0.019 |
| $k_2$ | 0.118 |

Figure 6:
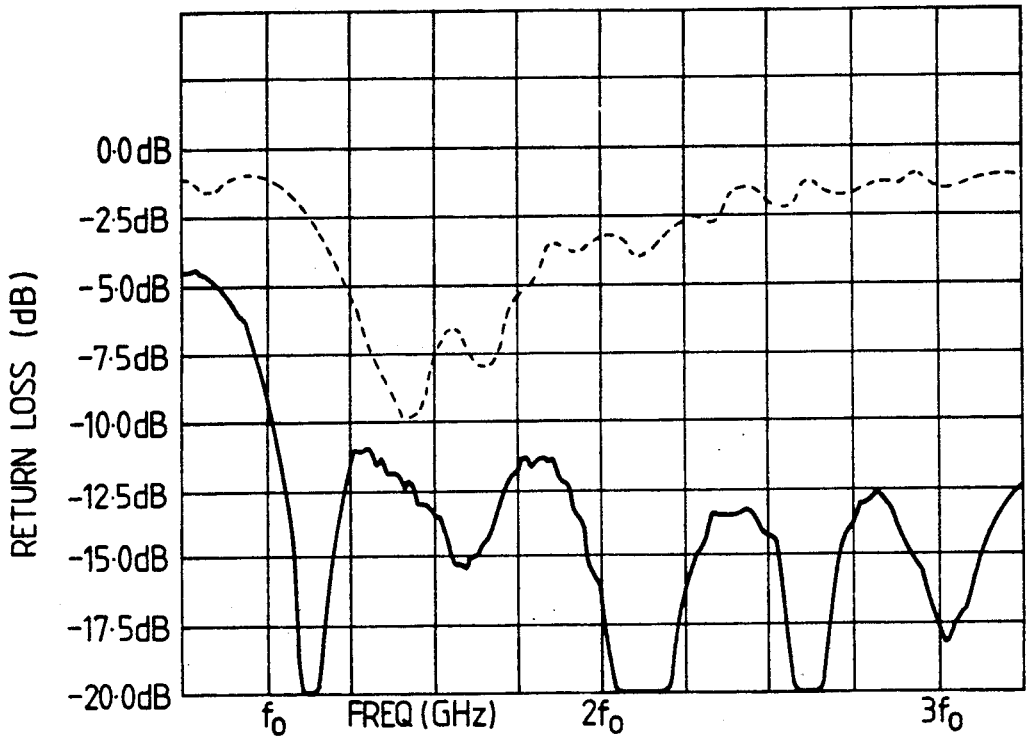
FIG. 6 is a plot of the return loss of a conventionally fed exponentially tapered slot antenna and of the antenna arrangement according to the invention.

FIG. 6 shows a comparison of the return loss of two exponentially tapered slot antenna arrangements over a 3:1 bandwidth, the antennas of both arrangements having the same slot profile. One arrangement whose return loss is shown by a dashed line has the standard 90° balun shown in FIG. 1, whereas the other arrangement whose return loss is shown by a full line has the 45° twist balun according to the invention shown in FIG. 5. The improved performance of the antenna with the 45° twist balun is apparent, having a return loss better than −10 dB over a 3 to 1 frequency band.

Figure 7:
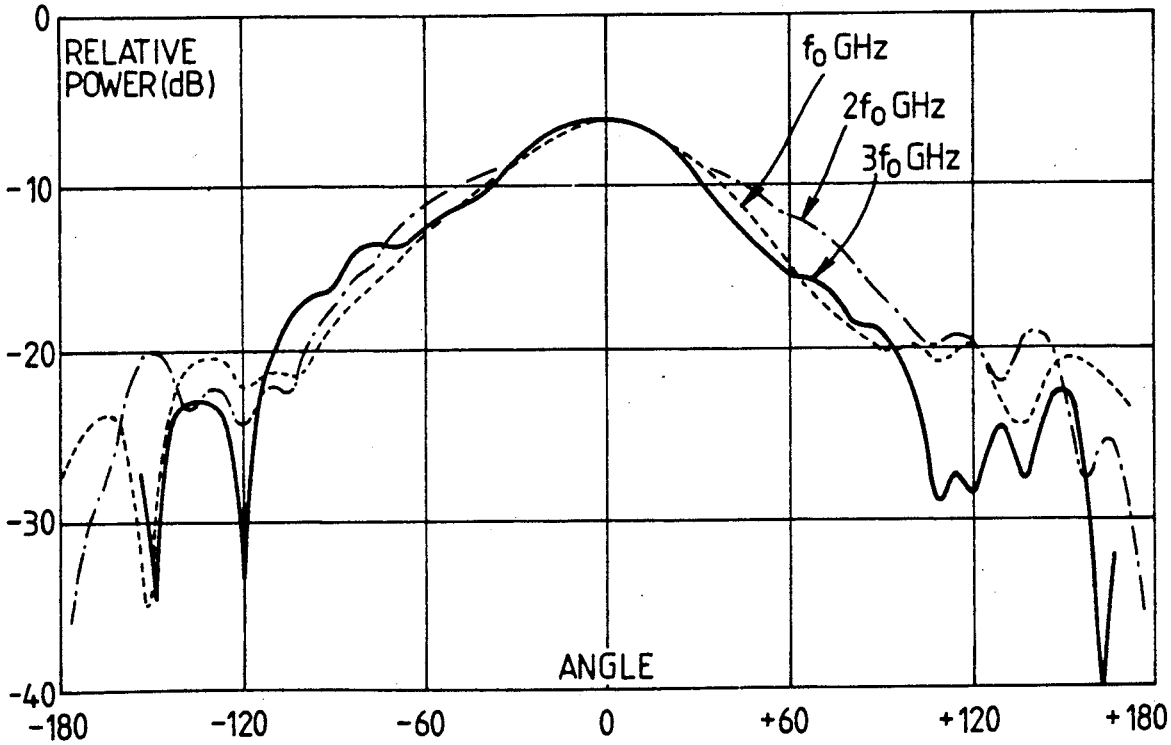
FIGS. 7 and 8 are respectively plots of the E-plane and according to the invention.
Figure 8:
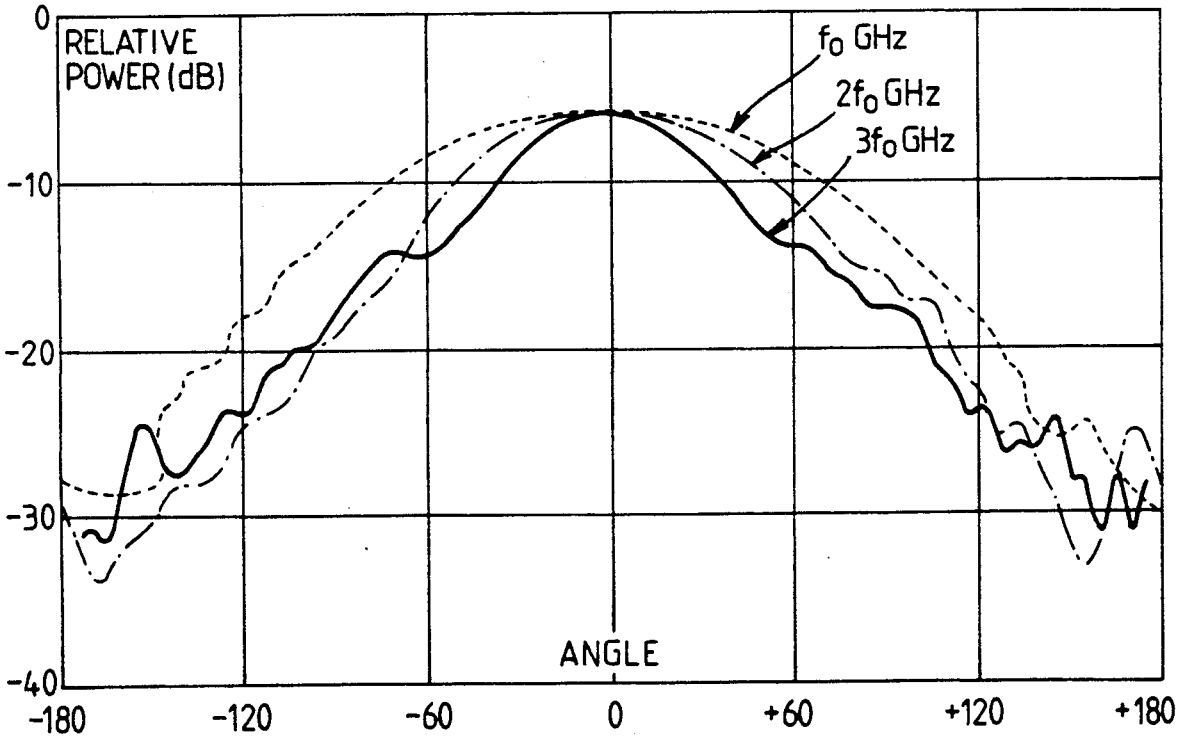

FIGS. 7 and 8 indicate respectively the E-plane and H-plane beamwidths of the antenna arrangement with the 45° twist balun according to the invention. The E-plane 3 dB beamwidth remains approximately 68 degrees over the design frequency range. The H-plane 3 dB beamwidth (FIG. 8) varies linearly from 120 degrees at $f_o$ to 60 degrees at $3f_o$. The gain of the antenna is nominally 6.5 dB and cross-polarisation in the E- and H-plane radiation patterns is −18 dB over the design frequency range. The beamwidth variation in the H-plane may be reduced by further optimisation of the slot profile for the substrate material used.

The superiority of the 45° twist balun is due to the 45° twists producing a broadband impedance match between the slot line and the microstrip line in the vicinity of the "cross-over" point. Although 45° has been found to be empirically the optimum angle of the twists in the slot line 14 and the stripline 16, other angles within +/−5° may be expected to produce a useful bandwidth capability.

The antenna arrangement described is found to be satisfactory for any 3 to 1 frequency band within the range 1 to 40 GHz.

Although the antenna arrangement described above comprises an antenna having an exponentially tapered slot, it will be appreciated that the invention is not so limited. Thus, the 45° twist balun may also be used to couple a feed line to an antenna having any form of tapered slot, for example, a linearly tapered slot.

I claim:

1. An antenna arrangement, comprising:

(a) an antenna, (b) a feed line for said antenna, and (c) a balun for coupling said antenna with said feed line, (d) said antenna comprising an electrically insulating planar substrate, an electrically conductive layer carried on a first face of two main faces of said insulating substrate, and a tapered slot formed in said conductive layer, the slot having a narrow end and a broad end, (e) said feed line comprising an electrically conductive strip carried on a second face of said two main faces of said insulating substrate, (f) said balun comprising a non-tapered slot line forming an extension of said narrow end of the tapered slot and terminated by an open-circuit termination, and a stripline formed as an extension of said feed line and terminated by a short-circuit termination, (g) said slot line comprising a first slot line section extending along a first axis and a second slot line section extending in a direction at an angle of 45° to said first axis, the two slot line sections meeting at a first point, (h) said stripline comprising a first stripline section extending along a second axis and a second stripline section extending in a direction at an angle of 45° to said second axis, the two stripline sections meeting at a second point, (i) said first point and said second point being substantially coincident in the plane of said insulating substrate.

2. An antenna arrangement according to claim 1, wherein said tapered slot is exponentially tapered.

3. An antenna arrangement according to claim 1, wherein said first stripline section extends between said feed line and said second point and said first slot line section extends between said narrow end of the tapered slot and said first point, said first axis and said second axis both being aligned with an axis of symmetry of said tapered slot.

4. An antenna arrangement according to claim 1, wherein said second stripline section extends between said second point and said short-circuit termination, said second stripline section having a length equal to one-quarter of the guide wavelength in said stripline at twice the lower operating frequency of said antenna, and said second slot line section extends between said first point and said open-circuit termination, said second slot line section having a length equal to one-quarter of the guide wavelength in said slot line at twice the lower operating frequency of said antenna.

5. An antenna arrangement according to claim 1, wherein said open-circuit termination comprises a circular slot formed in said conductive layer, said circular slot having a diameter equal to one-quarter of the guide wavelength in said slot line at the upper operating frequency of said antenna.

* * * * *